US006494130B2

(12) United States Patent
Brown

(10) Patent No.: US 6,494,130 B2
(45) **Date of Patent: *Dec. 17, 2002**

(54) COOKING APPARATUS INSULATED BY NON-FIBROUS MEANS

(75) Inventor: George T. Brown, Drums, PA (US)

(73) Assignee: The Garland Group, Freeland, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/498,117

(22) Filed: Feb. 4, 2000

(65) Prior Publication Data

US 2002/0033099 A1 Mar. 21, 2002

(51) Int. Cl.[7] ..... A21B 1/26; A47J 39/00

(52) U.S. Cl. ..... 99/324; 99/447; 99/476; 99/481; 126/21 A; 219/400; 219/757; 165/122; 165/135

(58) Field of Search ..... 99/324, 481, 447, 99/476; 126/273.5, 21 A; 219/399, 400, 757; 165/122, 135

(56) References Cited

U.S. PATENT DOCUMENTS

| | | | | | |
|---|---|---|---|---|---|
| 777,103 | A | * | 12/1904 | Kahn | |
| 1,249,620 | A | * | 12/1917 | Hardy | |
| 3,478,674 | A | * | 11/1969 | Medeiros | 99/347 |
| 4,180,049 | A | * | 12/1979 | Carr et al. | 126/21 A |
| 4,886,046 | A | * | 12/1989 | Welch | 126/299 D |
| 5,111,577 | A | | 5/1992 | Sheridan et al. | 29/890.039 |
| 5,373,836 | A | * | 12/1994 | Mifune et al. | 126/344 |
| 5,524,406 | A | * | 6/1996 | Ragland | 52/406.2 |
| 5,633,064 | A | | 5/1997 | Ragland et al. | 428/95 |
| 5,670,264 | A | * | 9/1997 | Sheridan | 428/594 |
| 5,768,781 | A | | 6/1998 | Shuler et al. | 29/890.03 |
| 5,780,822 | A | * | 7/1998 | Lee | 219/710 |
| 5,801,362 | A | * | 9/1998 | Pearlman et al. | 219/400 |
| 5,939,212 | A | * | 8/1999 | Ragland et al. | 428/594 |
| 6,097,000 | A | * | 8/2000 | Frasnetti et al. | 219/395 |

* cited by examiner

*Primary Examiner*—Keith Hendricks
*Assistant Examiner*—Drew Becker
(74) *Attorney, Agent, or Firm*—Ohlandt, Greeley, Ruggiero & Perle, LLP

(57) ABSTRACT

A cooking apparatus comprising a heatable component insulated by a heat insulating material, wherein the heat insulating material comprises a plurality of metal sheets that are spaced apart from each other by a separator.

20 Claims, 4 Drawing Sheets

COOKING APPARATUS INSULATED BY NON-FIBROUS MEANS

BACKGROUND OF THE INVENTION

1. Field of the Invention

This invention relates to cooking apparatus and, more particularly, to a cooking apparatus with non-fibrous insulation. In one embodiment of the present invention, the non-fibrous insulation enhances heat management in a controlled manner.

2. Description of the Prior Art

Cooking equipment is typically insulated using various types of fibrous insulation, such as fiberglass, cellulose, mineral wool, etc. The purpose of the insulation is to serve as a barrier to prevent heat from escaping the oven cavity and elevating the temperature of the exterior portion of the cooking apparatus creating hazardous operating conditions.

Several materials, such as fiberglass, cellulose, and mineral wool are currently used as insulation in cooking equipment. However, these materials have some disadvantages. Some of these materials cause irritation to human skin. This requires assembly personnel to wear protective clothing when handling such materials.

All of these fibrous insulation materials are hazardous to human health, when consumed. This causes a problem when particles of the insulation break off and contaminate food.

In addition, these materials may create air-borne particles that are hazardous to assembly personnel during handling and installation. This necessitates a need for such personnel to use breathing filters. Thus, the cost of production is increased because special precautions must be used when handling fibrous insulation.

Another disadvantage is that fibrous insulation, as us cooking equipment, is generally bulky material. This requires the cooking equipment to be unnecessarily large in size to house such unwieldy material. The cost of production of cooking equipment is increased because of the extra material that is needed to build a large enough housing for the fibrous insulation to fit. In addition, cooking equipment with this insulation is more expensive to operate because they take up more space during operation. In locations where space is at a premium, the overhead costs of operating cooking equipment with fibrous insulation will be increased.

Another disadvantage is that fibrous insulation absorbs liquid that may effectively reduce its insulating capability over time. This moisture absorption is also detrimental to the long-term life of the oven and its component parts. Furthermore, fibrous materials are not recyclable. Accordingly, there is a need for an improved insulation for cooking equipment that avoids the aforementioned disadvantages.

Furthermore, cooking equipment are generally known in the art to use natural convection as the sole method of heat removal. Accordingly, a need also exists for an efficient and controlled management of heat removal in cooking equipment.

SUMMARY OF THE INVENTION

The present invention provides a cooking apparatus having a heatable component that is at least partially insulated by a heat insulating material. The heat insulating material comprises a plurality of metal sheets spaced apart from each other by a separator. The heat insulating material also includes a heat sink that comprises a plurality of metal sheets that are compressed forming a stack.

The heat insulating material includes a heat radiating surface and a heat reflective surface, which are substantially parallel and face opposite directions. The heat reflective surface faces the heatable component, preferably a convection oven. Heat from the convection oven is reflected back towards the oven thereby reducing unwanted heat loss in the oven compartment. Heat is also conducted across the length and width of this surface, preferably an aluminum sheet. Heat is than radiated from this first metal sheet to a second sheet disposed underneath the first metal sheet. This same process is continued to a next underneath sheet, etc., until a last underneath sheet again functions in the same way. This last underneath sheet has a heat radiating surface that faces an air path in the oven compartment.

Passing an air stream through the cooking apparatus from an inlet to an outlet typically creates the air path. The air stream is directed into two paths. The first path includes the controls compartment and the second path includes the oven compartment. The second air path, in the oven compartment, is passed along peaks and troughs on the heat radiating surface. The peaks and troughs are oriented to aid in the management of the airflow through the oven compartment. In addition, heat is radiated from the heat-radiating surface into the air path. Thus, the cooking apparatus is efficiently cooled by directing airflow through the oven compartment, radiating heat into the air path, and controlling the airflow through the compartment by the peaks and troughs.

Preferably, the insulation is non-fibrous insulation in which the metal sheets are spaced apart by a separator. In one preferred embodiment, the present invention provides a non-fibrous insulation having a separator comprising a plurality of embossments. The embossments extend from the metal sheets and maintain the spaced apart relationship. Thus, insulating layers are formed between each metal sheet.

In a second embodiment, the present invention provides a non-fibrous insulation having a separator comprising a metal foil being formed in a geometric spacing pattern, preferably a hexagon. The separator is disposed between each metal sheet to maintain the spaced apart relationship, thereby forming insulating layers.

Other and further objects, advantages and features of the present invention will be understood by reference to the following specification in conjunction with the annexed drawings, wherein like parts have been given like numbers.

DESCRIPTION OF THE INVENTION

Figure 1:
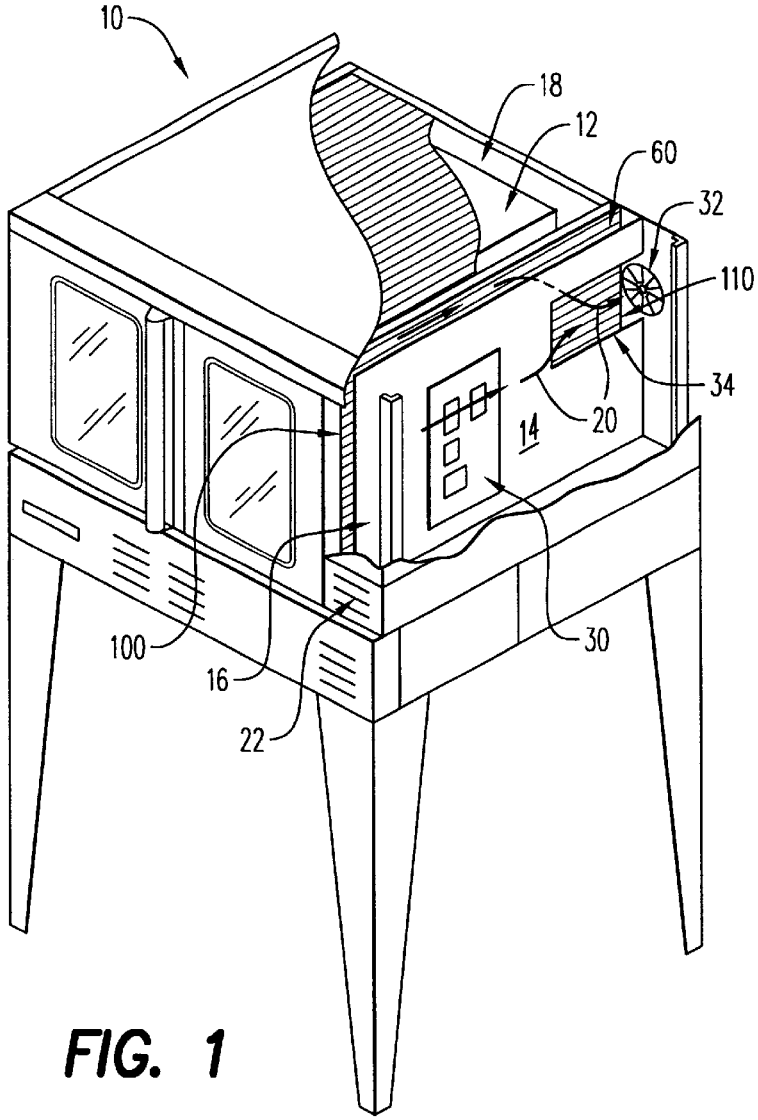
FIG. 1 is a perspective view of a cooking apparatus according to the present invention.

Referring to FIGS. 1, 5, 6, 7, and 8, the cooking apparatus of the present invention is generally referred to by reference numeral 10. Cooking apparatus 10 includes a heatable component 12 that is insulated by heat insulating material 60. In one embodiment, heatable component 12 is a convection oven. Cooking apparatus 10 further includes an oven compartment 18, a controls compartment 16, an inlet 22, an outlet 24 and a fan 32. Oven compartment 18 and controls compartment 16 are formed by a vertical panel 14. Convection oven 12 is disposed in oven component compartment 18. A control group 30 is disposed in controls compartment 16.

Fan 32 forms an air stream 20 between inlet 22 and outlet 24. Air stream 20 is directed in a first air path 26 through controls compartment 16 and a second air path 28 through oven compartment 18. Panel 14 has a slot 34 there through for the purpose of allowing airflow between controls compartment 16 and oven compartment 18. Panel 14 is connected to cooking apparatus 10 by a loose tolerance fit 36 (shown in FIG. 8).

Figure 2:
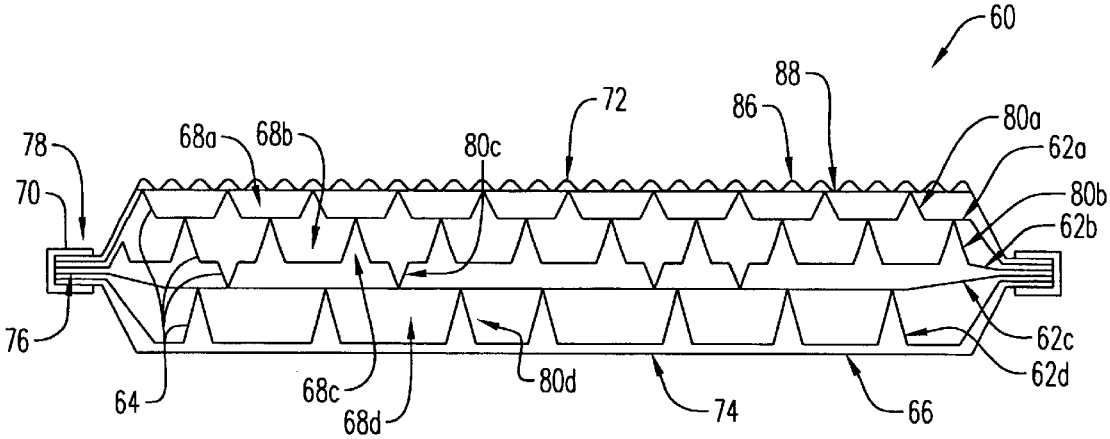
FIGS. 2 and 3 are cross-sectional views of alternate heat insulating materials that can be used in the present invention.

Referring to FIG. 2, in which like components have like reference numbers, heat insulating material 60 comprises a plurality of metal sheets 62*a*, 62*b*, 62*c*, and 62*d*. Metal sheets 62*a*, 62*b*, 62*c*, and 62*d* are spaced apart from each other by a separator 64. Heat insulating material 60 includes a heat sink 70. Heat sink 70 comprises two or more of metal sheets 62*a*, 62*b*, 62*c*, and 62*d* that extend into heat sink 70 and form a compressed stack 76. Metal sheets 62*a*, 62*b*, 62*c*, and 62*d* in heat sink 70 are secured together by securing means 78. Securing means 78 is preferably a metallurgical bond.

Heat insulating material 60 includes a plurality of insulating layers 68*a*, 68*b*, 68*c*, and 68*d*, as shown in FIG. 2. Heat sink 70 and insulating layers 68*a*, 68*b*, 68*c*, and 68*d* are adjacent to one another. Heat sink 70 provides better heat conduction in a vertical direction than insulating layers 68*a*, 68*b*, 68*c*, and 68*d*.

Heat insulating material 60 includes a heat radiating surface 72 and a heat reflective surface 74, which are substantially parallel and face opposite directions from each other. Heat reflective surface 74 faces convection oven 12. Heat radiating surface 72 has undulations forming peaks 86 and troughs 88. Heat radiating surface 72 is preferably a black coating surface, which increases the emissivity of the surface and decreases the reflectivity. Heat reflective surface 74 is preferably aluminum foil, which has a high reflectivity on the order of 95% and a low emissivity of about 10%.

Heat insulating material 60 includes a plurality of embossments 80*a*, 80*b*, 80*c*, and 80*d*. First insulating layer 68*a* includes first metal sheet 62*a*. First metal sheet 62*a* includes embossments 80*a* arranged in a uniform pattern.

Second insulating layer 68*b* includes second metal sheet 62*b*. Second metal sheet 62*b* includes embossments 80*b* and 80*c*. Embossments 80*b* are arranged in a uniform pattern on one side of second metal sheet 62*b* and embossments 80*c* are arranged in a non-uniform pattern on the other side thereof.

Third insulating layer 68*c* includes third metal sheet 62*c* that is a generally flat sheet.

Fourth insulating layer 68*d* includes fourth metal sheet 62*d*. Fourth metal sheet 62*d* includes embossments 80*d* arranged in a non-uniform pattern.

Figure 3:
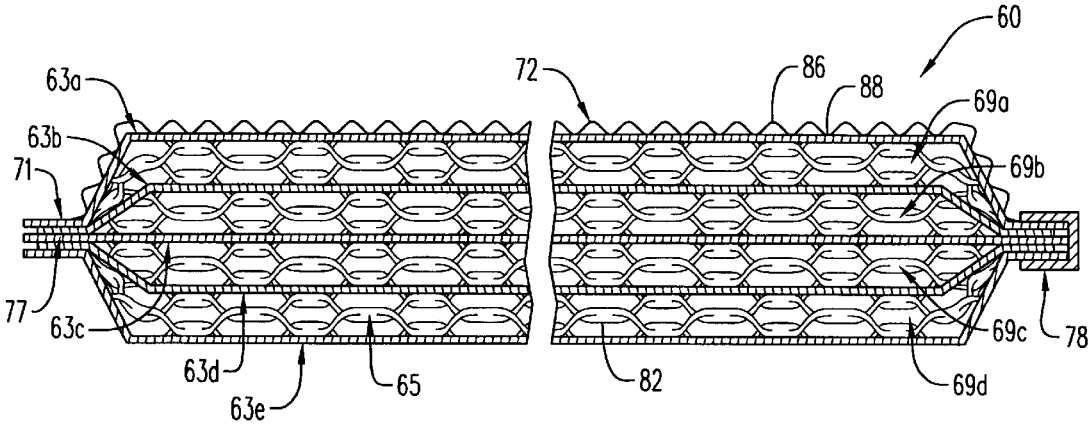

Referring to FIG. 3, in which like components have like reference numbers, heat insulating material 60 comprises a plurality of metal sheets 63*a*, 63*b*, 63*c*, 63*d*, and 63*e*. Metal sheets 63*a*, 63*b*, 63*c*, 63*d*, and 63*e* are spaced apart from each other by a separator 65. Heat insulating material 60 includes a heat sink 71. Heat sink 71 comprises two or more of metal sheets 63*a*, 63*b*, 63*c*, 63*d*, and 63*e* that extend into heat sink 71 and form a compressed stack 77. Metal sheets 63*a*, 63*b*, 63*c*, 63*d*, and 63*e* in heat sink 71 are secured together by securing means 79. Securing means 79 is preferably a metallurgical bond.

Heat insulating material 60 includes a plurality of insulating layers 69*a*, 69*b*, 69*c*, and 69*d*, as shown in FIG. 3. Heat sink 71 and insulating layers 69*a*, 69*b*, 69*c*, and 69*d* are adjacent to one another. Heat sink 71 provides better heat conduction in a vertical direction than insulating layers 69*a*, 69*b*, 69*c*, and 69*d*.

Heat insulating material 60 includes a heat radiating surface 72 and a heat reflective surface 74, which are substantially parallel and face opposite directions from each other. Heat reflective surface 74 faces convection oven 12. Heat radiating surface 72 has undulations forming peaks 86 and troughs 88. Heat radiating surface 72 is preferably a black coating surface, which increases the emissivity of the surface and decreases the reflectivity. Heat reflective surface 74 is preferably aluminum foil, which has a high reflectivity on the order of 95% and a low emissivity of about 10%.

First insulating layer 69*a* includes a first separator structure 65*a* that is disposed between first metal sheet 63*a* and second metal sheet 63*b*, thereby forming first insulating layer 69*a*. First separator structure 65*a* includes a first metal foil 82*a*. First metal foil 82*a* is formed in a geometric spacing pattern 84 throughout first insulating layer 69*a*, thereby separating first metal sheet 63*a* and second metal sheet 63*b*.

Second insulating layer 69*b* includes a second separator structure 65*b* that is disposed between second metal sheet 63*b* and third metal sheet 63*c*, thereby forming second insulating layer 69*b*. Second separator structure 65*b* includes a second metal foil 82*b*. Second metal foil 82*b* is formed in a geometric spacing pattern 84 throughout second insulating layer 69*b*, thereby separating second metal sheet 63*b* and third metal sheet 63*c*.

Third insulating layer 69*c* includes a third separator structure 65*c* that is disposed between third metal sheet 63*c* and fourth metal sheet 63*d*, thereby forming third insulating layer 69*c*. Third separator structure 65*c* includes a third metal foil 82*c*. Third metal foil 82*c* is formed in a geometric spacing pattern 84 throughout third insulating layer 69*c*, thereby separating third metal sheet 63*c* and fourth metal sheet 63*d*.

Fourth insulating layer 69*d* includes a fourth separator structure 65d that is disposed between fourth metal sheet 63*d* and fifth metal sheet 63*e*, thereby forming fourth insulating layer 69*e*. Fourth separator structure 65*d* includes a fourth metal foil 82*d*. Fourth metal foil 82*d* is formed in a geometric spacing pattern 84 throughout fourth insulating layer 68*e*, thereby separating fourth metal sheet 63*d* and fifth metal sheet 63*e*.

Figure 4:
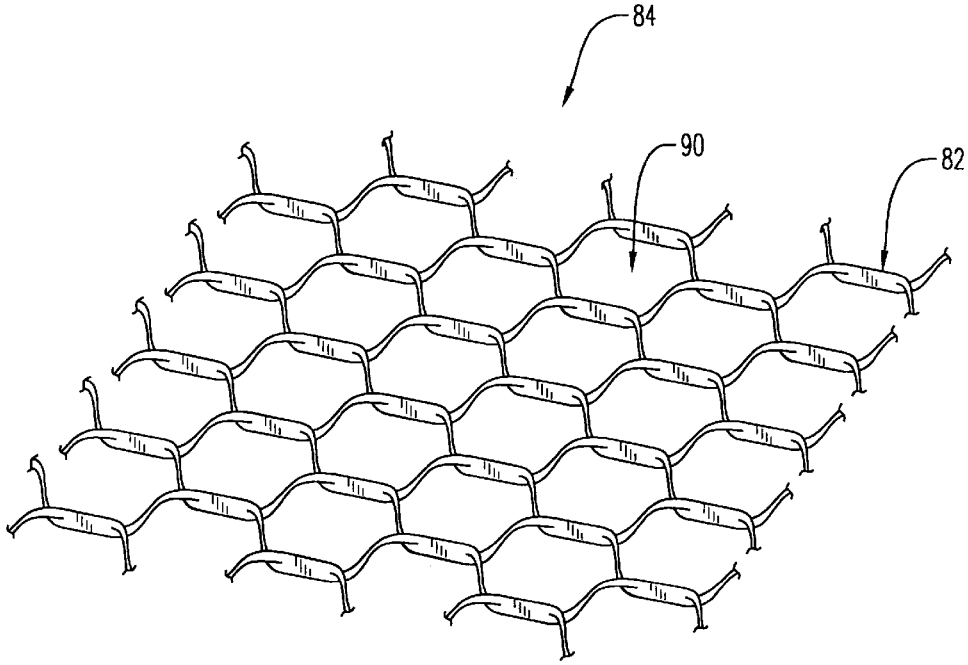
FIG. 4 is a perspective view of the geometric spacing pattern of the FIG. 3 insulation.

Referring to FIG. 4, in a preferred embodiment of the invention, geometric spacing pattern 84 is a hexagon 90.

A significant feature of the present invention is the construction of heat insulating material 60. Heat insulating material 60 is constructed of non-fibrous material and is safer and less costly to use in the production of cooking apparatus 10. In addition, heat insulating material 60 is thinner than the traditional fibrous insulation, thereby reducing the overall size of cooking apparatus 10. This reduction in size of cooking apparatus 10 allows the present invention to be used in places where space is at a premium, thereby reducing operating expenses.

Furthermore, the non-fibrous material construction of heat insulating material 60 is preferred in caustic environments, which occur in cooking equipment, because this type of material can better endure high temperatures, high moisture levels, and corrosive conditions than conventional type fiber insulators. In addition, non-fibrous materials have a greater rigidity and compressive strength which allows heat insulating material 60 to withstand greater impacts during use.

Another significant feature of the present invention is the spaced apart relationship of the metal sheets, as shown in FIGS. 2 and 3, of heat insulating material 60. The space between the sheets provides pockets of air for insulation. A first sheet, adjacent to a heat source absorbs heat, and this heat is than conducted across the length and width of the first sheet. Heat is also radiated from the first sheet to a second sheet disposed underneath the first sheet. This same process is continued to a next underneath sheet, etc., until a last underneath sheet again functions in the same manner as described above in connection with the first sheet. The last underneath sheet in this process is kept relatively cool and thus components kept next to this sheet are also relatively cool.

In addition, the separators, as shown in FIGS. 2 and 3, maintain the spaced apart relationship between the sheets. At every point of contact between the metal sheets, unwanted conduction heat transfer through the insulator occurs. The separator will also decrease the movement of convection currents between adjacent metal sheets. This decreases unwanted heat transfer by convection through the insulator. Thus, it is preferable to maintain this spaced apart relationship with as few point contacts as possible and with minimal air currents between adjacent sheets.

Another significant feature of cooking apparatus 10 is the construction and placement of heat reflective surface 74 and heat sink 70. Heat sink 70 and heat reflective surface 74 allow heat insulating material 60 to better manage heat transfer. Heat reflective surface 74, which has a reflectivity on the order of 95%, significantly reduces heat loss from oven compartment 18 by reflecting heat back at convection oven 12. The heat that does manage to escape is conducted away towards heat sink 70. Heat sink 70 can be coated with an emissive material allowing the heat to be radiated away from heat insulating material 60. Thus, heat insulating material 60 can either reflect heat back at the source, convection oven 12, or direct heat away from the source towards heat sink 70.

The present invention also provides a novel dual airflow path 26 and 28 through control compartment 16 and oven compartment 18. This feature allows cooling air stream 20 to flow through first air path 26, including control compartment 16, and second air path 28, including oven compartment 18, thereby aiding in the efficient removal of heat from cooking apparatus 10.

Cooking apparatus 10 also includes heat radiating surface 72 which is positioned such that peaks 86 and troughs 88 are aligned with second air path 28 to aid in the management of airflow through oven compartment 18. Heat radiating surface 72 has heat radiating means that aids in the transfer of heat away from heat insulating material 60 and towards air stream 20. Peaks 86 and troughs 88 efficiently control air stream 20 through oven compartment 18, thereby cooling oven compartment 18 efficiently.

According to the method of the present invention, air stream 20 is formed to pass through and cool cooking apparatus 10. Air stream 20 enters cooking apparatus 10 through inlet 22. Air stream 20 is directed into first air path 26 and second air path 28 by means of loose tolerance fitting 36 of panel 14. First air path 26 includes controls compartment 16 and cools control group 30. Second air path 28 includes oven compartment 18 and cools convection oven 12, as discussed above. First air path 26 and second air path 28 are merged together at slot 34 in panel 14 and are exhausted out of cooking apparatus 10 through outlet 24. The method of cooling cooking apparatus 10, by dual air paths 26 and 28, is an efficient method of managing heat transfer.

Figure 5:
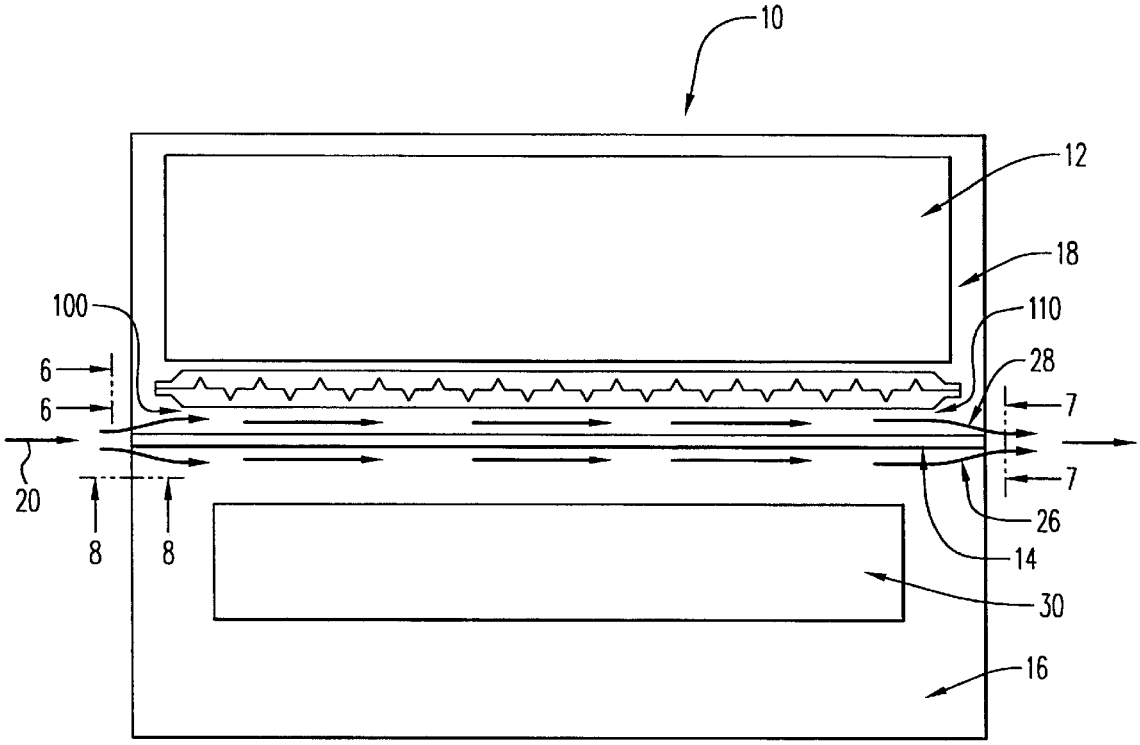
FIG. 5 is a top view of the cooking apparatus of FIG. 1 with the top panel removed.
Figure 6:
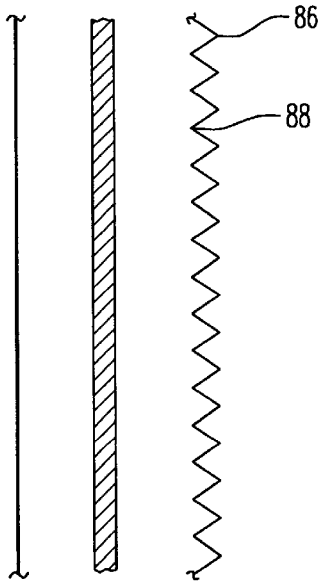
FIG. 6 is a side elevation view along line 6—6 of FIG. 5.
Figure 7:
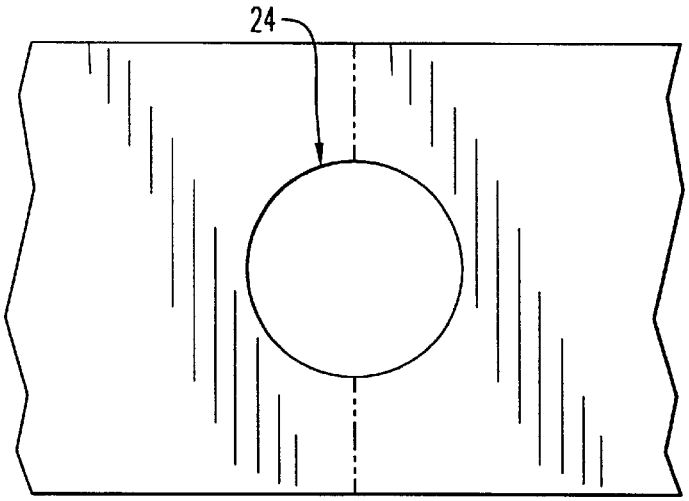
FIG. 7 is a side elevation view along line 7—7 of FIG. 5.
Figure 8:
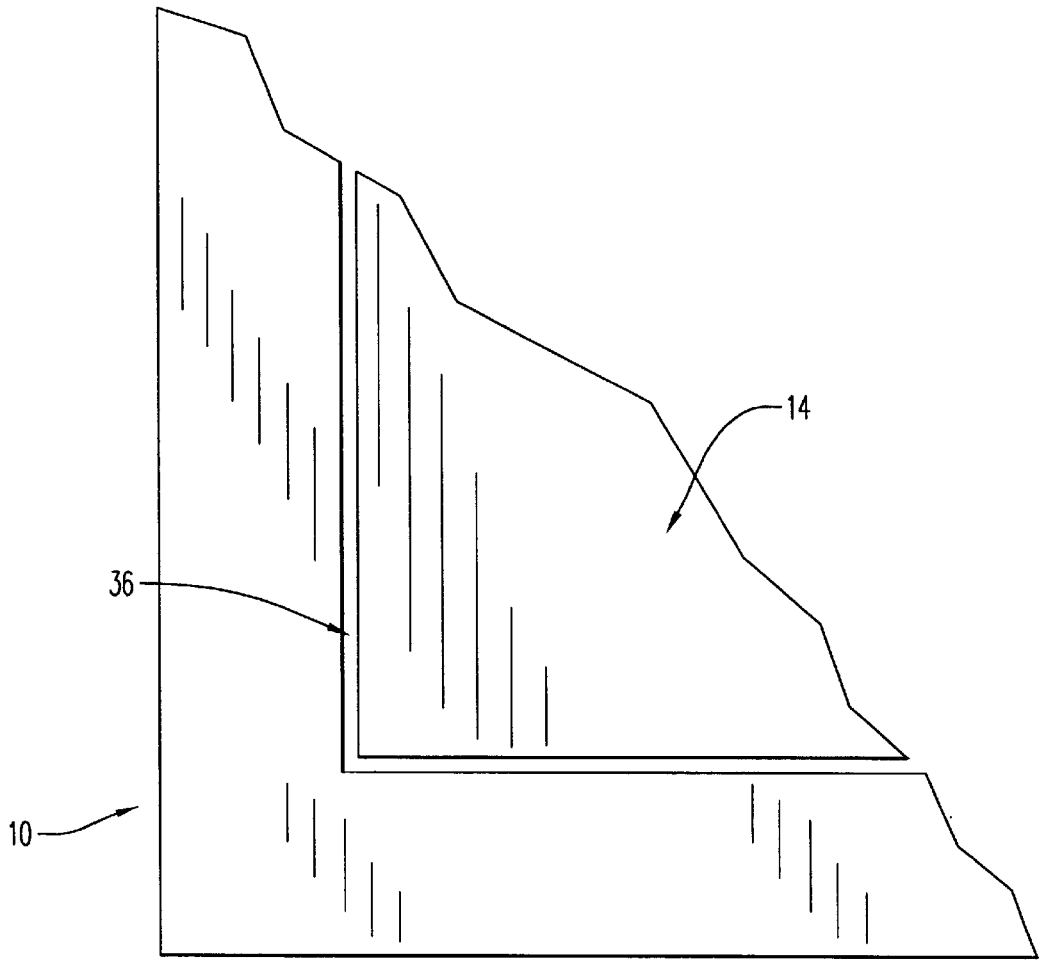
FIG. 8 is a side elevation view along line 8—8 of FIG. 5.

Referring to FIGS. 1, 5 and 7, heat radiating surface 72 has a first edge 100 and a second edge 110. First edge 100 and second edge 110 are disposed on opposite sides of heat insulating material 60. First edge 100 is generally adjacent to inlet 22 and second edge 110 is generally adjacent to outlet 24. Air stream 20 that flows through second air path 28 travels along heat radiating surface 72 from first edge 100 to second edge 110.

The present invention having been thus described with particular reference to the preferred forms thereof, it will be obvious that various changes and modifications may be made therein without departing from the spirit and scope of the present invention as defined in the appended claims.

What is claimed is:

1. A cooking apparatus comprising:

an oven insulated by a non-fibrous heat insulating material, said heat insulating material comprising a heat reflective surface that faces said oven, a heat radiating surface that faces away from said oven and a plurality of metal sheets that are spaced apart from each other by a separator and that are disposed between said heat radiating surface and said heat reflective surface;

an oven compartment in which said oven and said heat insulating material are disposed;

a control compartment containing a control group;

an inlet;

an outlet; and a fan that forms an air stream from said inlet to said outlet, wherein said air stream separates into a first air path and a second air path, said first air path traveling through said control compartment to cool said control group and said second air path traveling through said oven compartment along said radiating surface.

2. The cooking apparatus according to claim 1, wherein said heat radiating surface has undulations that form substantially parallel peaks and troughs and said second air path travels in a direction that is substantially parallel to said peaks and troughs so as to efficiently transfer heat from said radiating surface along said peaks and troughs.

3. The cooking apparatus according to claim 1, wherein said heat insulating material further comprises a heat sink.

4. The cooking apparatus according to claim 1, wherein said heat insulating material comprises a first insulating layer and a second insulating layer.

5. The cooking apparatus according to claim 4, wherein said plurality of metal sheets comprises a first, second and third metal sheet.

6. The cooking apparatus according to claim 5, wherein said separator includes a first separator structure and a second separator structure, said first separator structure being disposed between said first and said second metal sheets, thereby forming said first insulating layer, said second separator structure being disposed between said second and said third metal sheets, thereby forming said second insulating layer.

7. The cooking apparatus according to claim 6, wherein said first separator structure comprises a first metal foil, said first metal foil being formed in a geometric spacing pattern, said second separator structure includes a second metal foil, said second metal foil being formed in said geometric spacing pattern.

8. The cooking apparatus according to claim 7, wherein said geometric spacing pattern is a hexagon.

9. The cooking apparatus according to claim 5, wherein said separator comprises a first separator structure and a second separator structure, said first separator structure comprises a plurality of embossments extending from said second metal sheet, thereby forming said first insulating layer between said first and said second metal sheets, said second separator structure comprises a plurality of embossments extending from said third metal sheet, thereby forming said second insulating layer between said second and said third metal sheets.

10. The cooking apparatus according to claim 3, wherein two or more of said plurality of metal sheets extend into said heat sink and form a compressed stack.

11. The cooking apparatus according to claim 4, wherein said heat insulating material further comprises a heat sink which is adjacent to said first insulating layer and said second insulating layer.

12. The cooking apparatus according to claim 10, wherein said plurality of metal sheets are secured together by securing means in said heat sink.

13. The cooking apparatus according to claim 12, wherein said securing means comprises a metallurgical bond between said metal sheets.

14. The cooking apparatus according to claim 1, wherein said oven is a convection oven having an external surface and said heat insulating material covers at least a portion of said external surface, and wherein said heat reflective surface faces said external surface and said heat radiating surface faces away from said external surface.

15. A cooking apparatus comprising:

an oven insulated by a non-fibrous heat insulating material, said heat insulating material comprising a heat reflective surface that faces said oven, a heat radiating surface that faces away from said oven and a plurality of metal sheets that are spaced apart from each other by a separator and that are disposed between said heat radiating surface and said heat reflective surface;

an oven compartment in which said oven and said heat insulating material are disposed;

a control compartment containing a control group;

a panel that defines said oven compartment and said control compartment;

an inlet;

an outlet; and a fan that forms an air stream from said inlet to said outlet, wherein said air stream separates into a first air path and a second air path, said first air path and said second air path being separated by said panel, said first air path traveling through said control compartment to cool said control group and said second air path traveling through said oven compartment along said radiating surface.

16. The cooking apparatus according to claim 15, wherein said panel has a slot, and wherein said first air path and said second air path merge together at said slot.

17. The cooking apparatus according to claim 16, wherein said fan is positioned to straddle said slot.

18. The cooking apparatus according to claim 15, wherein said heat radiating surface has undulations that form substantially parallel peaks and troughs and said second air path travels in a direction that is substantially parallel to said peaks and troughs so as to efficiently transfer heat from said radiating surface along said peaks and troughs.

19. The cooking apparatus according to claim 15, wherein said heat radiating surface has a first edge and a second edge, said first edge and said second edge being on opposing sides of said heat radiating surface, and wherein said second air path travels from said first edge to said second edge along said radiating surface.

20. The cooking apparatus according to claim 15, wherein said oven is a convection oven having an external surface and said heat insulating material covers at least a portion of said external surface, and wherein said heat reflective surface faces said external surface and said heat radiating surface faces away from said external surface.

* * * * *